US008381741B2

(12) United States Patent
Montgomery

(10) Patent No.: US 8,381,741 B2
(45) Date of Patent: Feb. 26, 2013

(54) HEADBAND WITH HAIRPIECE

(76) Inventor: Deborah Ann Montgomery, Mesa, AZ (US)

( * ) Notice: Subject to any disclaimer, the term of this patent is extended or adjusted under 35 U.S.C. 154(b) by 0 days.

(21) Appl. No.: 13/151,017

(22) Filed: Jun. 1, 2011

(65) Prior Publication Data

US 2012/0247495 A1 Oct. 4, 2012

Related U.S. Application Data

(60) Provisional application No. 61/468,162, filed on Mar. 28, 2011.

(51) Int. Cl.
*A41G 3/00* (2006.01)
*A41G 5/00* (2006.01)
*A45D 8/12* (2006.01)

(52) U.S. Cl. ..... 132/201; 132/53; 132/275

(58) Field of Classification Search ..... 132/53, 132/201, 54–56, 275
See application file for complete search history.

(56) References Cited

U.S. PATENT DOCUMENTS 2,567,119 A * 9/1951 Naidor ..... 2/200.1
3,295,536 A * 1/1967 Shaw et al. ..... 132/53
3,385,305 A * 5/1968 Buzzelli ..... 132/105
3,460,546 A * 8/1969 Abbott ..... 132/53
3,495,603 A * 2/1970 Young, Jr. ..... 132/53
4,966,173 A * 10/1990 Russell ..... 132/54
5,647,384 A * 7/1997 Haber et al. ..... 132/105
5,806,535 A * 9/1998 Becker ..... 132/54
2007/0074736 A1* 4/2007 Rotondi ..... 132/53
2008/0121245 A1* 5/2008 Trammell ..... 132/53
2010/0326455 A1* 12/2010 Karsenti et al. ..... 132/53

* cited by examiner

*Primary Examiner* — Robyn Doan
(74) *Attorney, Agent, or Firm* — Schmeiser, Olsen & Watts LLP

(57) ABSTRACT

A device for supplementing human hair is disclosed. The device for supplementing human hair includes a headband and a hairpiece coupled to the headband. The headband is shaped to frictionally engage the human scalp. The hairpiece integrates with existing hair on the head of a user so that the hairpiece supplements and enhances existing hair. The headband includes a crown piece. The hairpiece includes a hairpiece base and a set of hair. The hairpiece base couples to the crown piece so that the headband holds the hairpiece in place on the scalp. A method of forming a hair supplementing device is disclosed which includes the steps of obtaining a headband, where the headband includes a crown piece, and obtaining a hairpiece, where the hairpiece comprises means to couple the hairpiece to the crown piece.

10 Claims, 9 Drawing Sheets

HEADBAND WITH HAIRPIECE

CROSS REFERENCE TO RELATED APPLICATION

This application claims priority to U.S. Provisional Patent Application to Deborah Ann Montgomery entitled "Headband with small hair piece attached to top for people who have thinning hair," Ser. No. 61/468,162 filed Mar. 28, 2011, the disclosure of which is hereby incorporated entirely herein by reference.

BACKGROUND OF THE INVENTION

1. Technical Field

This invention relates generally to wigs and hairpieces and in particular to a hairpiece for supplementing human hair in a thinning or balding spot on the head.

2. State of the Art

Wigs, hairpieces, and toupees have been used through history to supplement, replace, or adorn human hairstyles. These hair supplementing devices are often made from human hair or other natural or synthetic fibers. Wigs, hairpieces, and toupees are temporarily attached to the head to replace or supplement an individual's existing hair. Wigs often cover the scalp completely, replacing any existing hair with the hair of the wig. Hairpieces and toupees are often integrated into existing hair to cover bald spots on the head or to supplement thinning areas. Wigs, hairpieces, or toupees can also be used as hair fashion accessories, allowing an individual to easily change the length, color, or look of their own hair.

When a hairpiece is integrated into existing hair, a method of attaching the hairpiece onto the head is needed. The usual method of integrating a hairpiece into existing hair is to use bobby pins or other type of clip to hold the hairpiece to existing hair. One problem with this method of attachment is that clips tend to slip or move over time, allowing the hairpiece to move on the head. Another problem is that wind or other pressure or force on the hairpiece can cause the hairpiece to move or fall off. Thus it is desirable to have a hairpiece which can be easily and securely attached to the head, so that the hairpiece can be integrated into existing hair and stay in position throughout the time it is worn.

DISCLOSURE OF THE INVENTION

This invention relates generally to wigs and hairpieces and in particular to a hairpiece for supplementing human hair in a thinning or balding spot on the head. Disclosed is a device for supplementing human hair which includes a headband and a hairpiece coupled to the headband. The headband frictionally engages a human scalp. In some embodiments the headband includes a headband body portion, where the headband body portion frictionally engages the human scalp, and a crown piece coupled to the headband body portion. In some embodiments the hair piece comprises a hairpiece base, and a set of hair coupled to the hairpiece base. In some embodiments the hairpiece base couples to the crown piece. In some embodiments the hairpiece base includes one or more than one pocket, wherein the one or more than one pocket receives the crown piece. In some embodiments the hairpiece base is glued to the crown piece. In some embodiments the hairpiece base is sewn to the crown piece.

Disclosed is a hair supplementing device which includes a headband that includes a crown piece, and a hairpiece coupled to the crown piece. In some embodiments the hair piece is removably coupled to the crown piece. In some embodiments the crown piece is removably coupled to the headband. In some embodiments the crown piece is an integral part of the headband. In some embodiments the crown piece is arched to fit the shape of a human scalp. In some embodiments the crown portion further includes a front portion, where the front portion extends out from a headband body portion in a frontward direction, and a rear portion, where the rear portion extends out from the headband body portion in a rearward direction. In some embodiments the crown piece has a length of about 2 and ½ inches. In some embodiments the crown piece has a width of about 1 and ⅞ inches.

A method of forming a hair supplementing device is disclosed, which includes the steps of obtaining a headband, where the headband comprises a crown piece; and obtaining a hairpiece, where the hairpiece comprises means to couple the hairpiece to the crown piece. In some embodiments the step of obtaining a headband, where the headband comprises a crown piece, includes the steps of forming a crown piece, coupling a first headband arm to the crown piece; and coupling a second headband arm to the crown piece. In some embodiments the step of obtaining a headband, where the headband comprises a crown piece, includes the steps of forming a headband body portion, forming a crown piece, and coupling the crown piece to the headband body portion. In some embodiments the step of obtaining a headband, where the headband comprises a crown piece, includes the step of forming a headband with an integral crown piece. In some embodiments obtaining a hairpiece includes forming a hairpiece with one or more than one pocket for receiving the crown piece. In some embodiments method 200 includes the step of coupling the hairpiece to the crown piece.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to wigs and hairpieces and in particular to a hairpiece for supplementing human hair in a thinning or balding spot. The device for supplementing human hair according to the invention provides a hairpiece with supplemental hair that fills in balding or thinning areas in a human head of hair. The device for supplementing human hair according to the invention includes the hairpiece and a headband. The hairpiece is coupled to the headband. The headband holds the hairpiece in place on a scalp such that the hairpiece is integrated into and supplements existing hair. The headband can be worn so that it is not seen or it can be worn in a position where it is seen and adds to the hairstyle.

Figure 1:
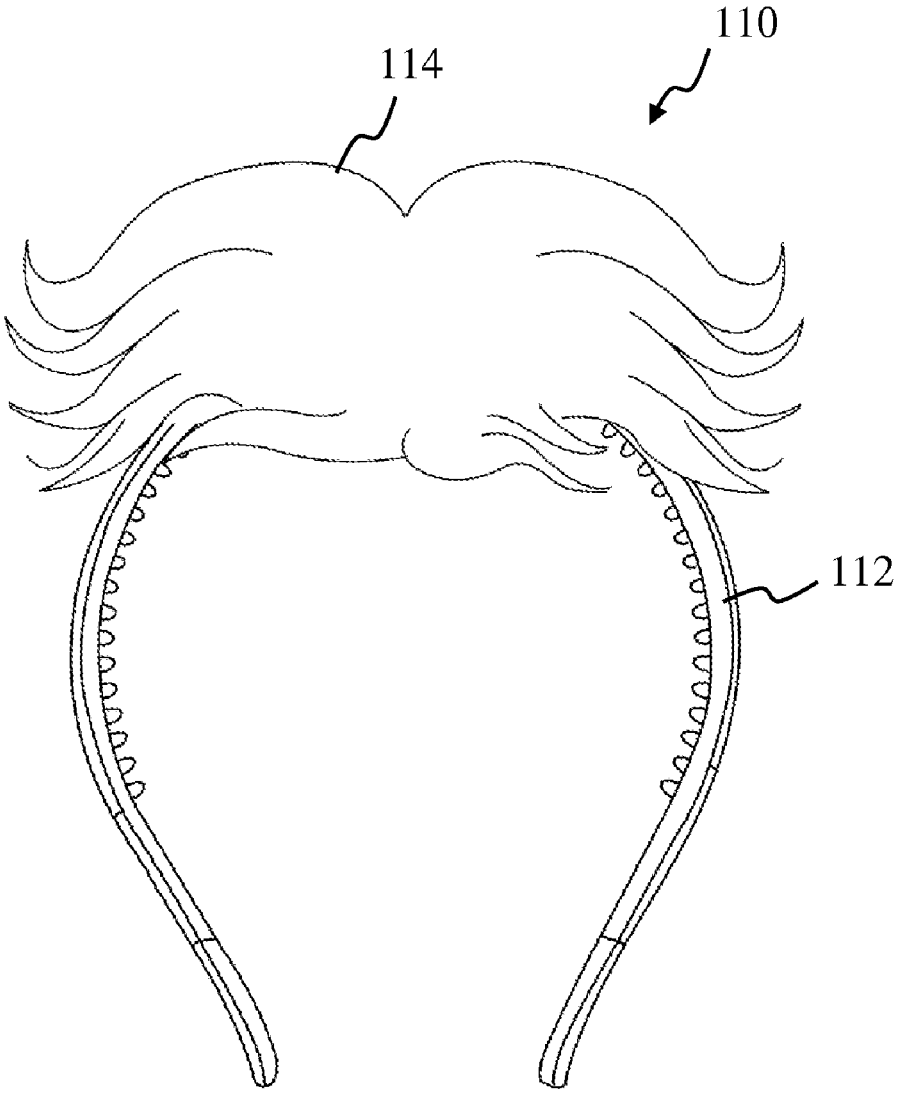
FIG. 1 is a front view of one embodiment of device for supplementing human hair 110 according to the invention.
Figure 2:
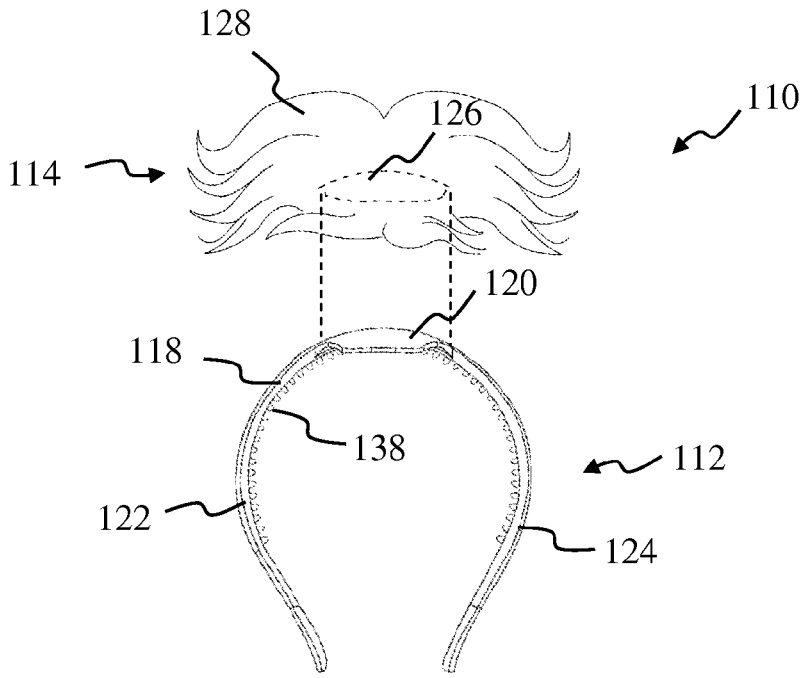
FIG. 2 is an exploded front view of device for supplementing human hair 110 of FIG. 1.

FIG. 1 shows a front view of device for supplementing human hair 110 according to the invention. Device for supplementing human hair 110 includes headband 112 and hairpiece 114 coupled to headband 112. Headband 112 is shaped to frictionally engage a human scalp. FIG. 2 shows an exploded view of device for supplementing human hair 110 of FIG. 1, showing hairpiece 114 and headband 112 decoupled from each other. Headband 112 includes crown piece 120. Hairpiece 114 couples to crown piece 120.

Hairpiece 114 includes hairpiece base 126, and set of hair 128 coupled to hairpiece base 126, as shown in FIG. 2. Hairpiece base 126 couples to crown piece 120. In some embodiments hairpiece base 126 is removably coupled to crown piece 120. Hairpiece base 126 being removably coupled to crown piece 120 is advantageous for using the same headband 120 with multiple hairpieces 114. In some embodiments hairpiece base 126 is not removably coupled to crown piece 120.

Figure 3:
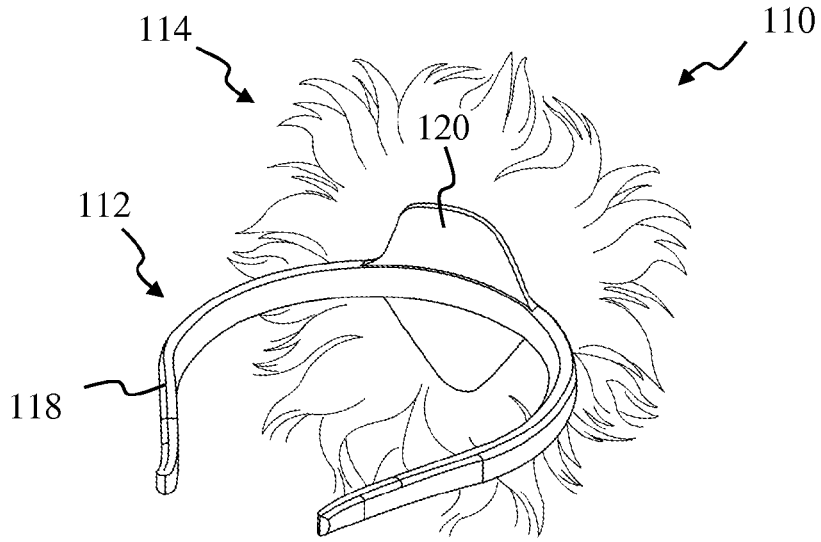
FIG. 3 is a bottom perspective view of an embodiment of device for supplementing human hair 110 according to the invention.

FIG. 3 shows a bottom perspective view of an embodiment of hair supplementing device 110 according to the invention. In the embodiment of device for supplementing human hair of FIG. 3, hairpiece base 126 is glued to crown piece 120. In the embodiment shown in FIG. 3, headband 112 does not include teeth 138 as shown in FIG. 1 and FIG. 2, but it is to be understood that teeth 138 can be used with any of the embodiments of device for supplementing human hair 110 illustrated in this document.

In the embodiment of device for supplementing human hair 110 shown in FIG. 1 and FIG. 2, headband 112 includes headband body portion 118, and crown piece 120 coupled to headband body portion 118. Headband body portion 118 is the part of headband 112 which is shaped to frictionally engage the human scalp. In this embodiment headband body portion 118 is formed in an inverted U-shape, with first arm 122 and second arm 124 as the two arms of the U. Headband body portion 118 is in this embodiment formed of a flexible material, with first arm 122 and second arm 124 biased towards their resting position so that when headband 112 is placed on the head, first arm 122 and second arm 124 of headband body portion 118 frictionally engage scalp 116 (see FIG. 4), which holds device for supplementing human hair 110 firmly in place on the head. In this embodiment headband 112 includes teeth 138 which grip scalp 116. In some embodiments headband 112 does not include teeth 138. In some embodiment headband 112 include other devices for frictionally engaging scalp 116. Teeth 138 are not shown in all the drawings of headband 112 in this document for simplicity sake, but it is to be understood that teeth 138 can be used on other embodiments of headband 112 according to the invention.

Figure 4:
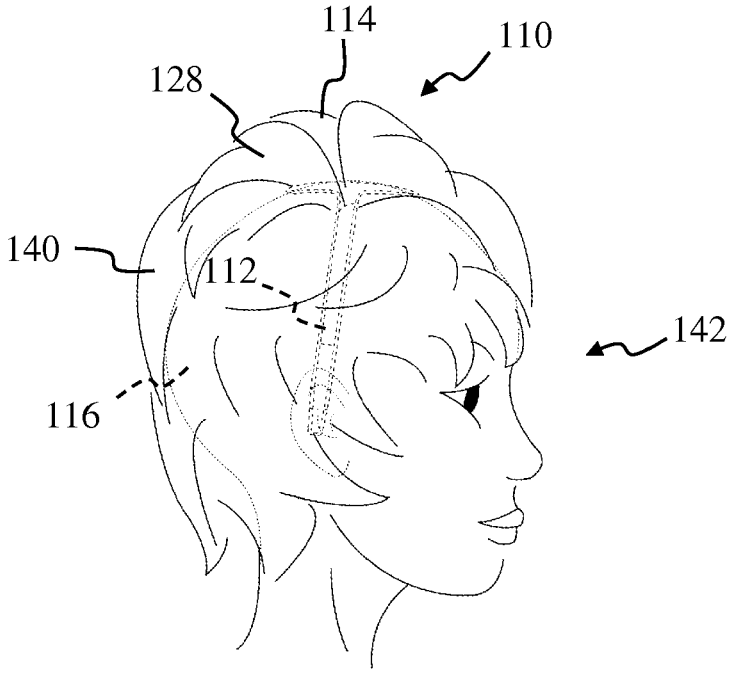
FIG. 4 is a side perspective view of an embodiment of device for supplementing human hair 110 according to the invention being used on head 142, showing that headband 112 frictionally engages scalp 116.
Figure 5:
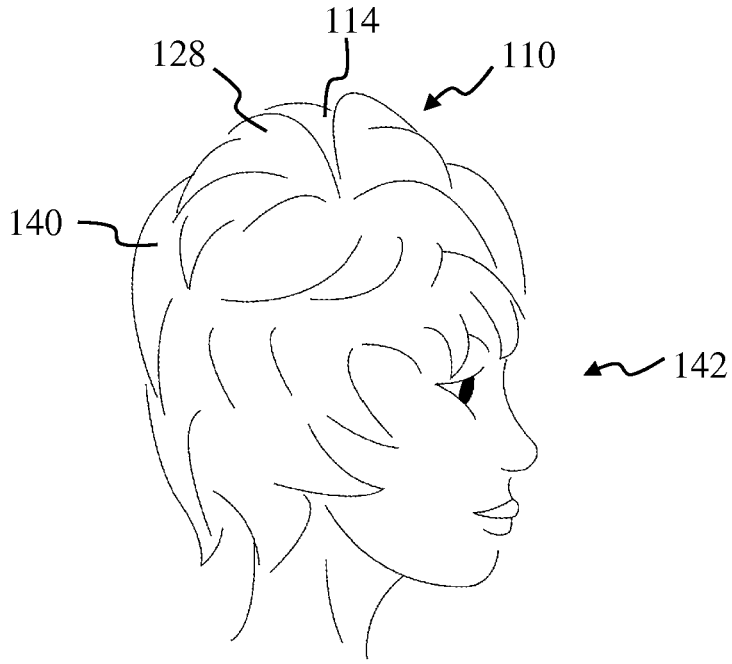
FIG. 5 is a side perspective view of device for supplementing human hair 110 of FIG. 4 being used on head 142, showing that set of hair 128 of hairpiece 114 integrates into existing hair 140 of head 142.

FIG. 4 and FIG. 5 show side views of device for supplementing human hair 110 of FIG. 1 being used on head 142. As shown in FIG. 4, headband 112 frictionally engages human scalp 116 of head 142. Hairpiece 114 is coupled to headband 112. Set of hair 128 of hairpiece 114 adds to existing human hair 140 to create a fuller head of hair on head 142. As shown in FIG. 5, set of hair 128 of hairpiece 114 supplements human hair 140. In the embodiment shown in FIG. 4 and FIG. 5, device for supplementing human hair 110 is used in a manner such that headband 112 is not visible. Device for supplementing human hair 110 can be worn such that headband 112 is visible and becomes part of the hairstyle. In some embodiments headband 112 can be fashionably adorned or patterned. Device for supplementing human hair 110 can be easily placed on the head and removed. Set of hair 128 can be styled into hair 140 in many different ways. Set of hair 128 adds to the thickness, and in some embodiments the length, of hair 140 of the person wearing device for supplementing human hair 110.

As mentioned earlier, hair supplementing device 110 according to the invention includes headband 112, where headband 112 includes crown piece 120. Headband 112 includes headband body portion 118 which frictionally engages scalp 116, and crown piece 120 coupled to headband body portion 118. Hair supplementing device 110 according to the invention also includes hairpiece 114 coupled to crown piece 120.

Hairpiece 114 includes hairpiece base 126, and set of hair 128, as shown in FIG. 2. Set of hair 128 is coupled to hairpiece base 126. Set of hair 128 can be attached to hairpiece base 126 in many different ways, as is known in the art of hairpieces. Hairpiece base 126 is often made of a mesh or weaved fabric that lends itself to having set of hair 128 weaved into it. In some embodiments hairpiece base 126 is made of monofilament welded mesh. In some embodiments hairpiece base 126 is made of a polyurethane coated fabric. In some embodiments hairpiece base 126 is made of a fabric with a coating other than polyurethane. Hairpiece base 126 can be made of any material, mesh, fabric, or substance that can be made to securely hold set of hair 128.

Set of hair 128 can be human hair, synthetic hair, or any type of hair substance or material that an individual would like to integrate into their own hair. In some embodiments set of hair 128 is made using the hair of the individual that will be wearing hair supplementing device 110. Set of hair 128 is often weaved into hairpiece base 126 so that set of hair 128 is securely fastened to hairpiece base 126. Set of hair 128 can include hair of all the same length or hair of different lengths, depending on the hairstyle and hair effect desired. In some embodiments set of hair 128 includes hair with lengths varying from one inch to 12 inches long.

Figure 6:
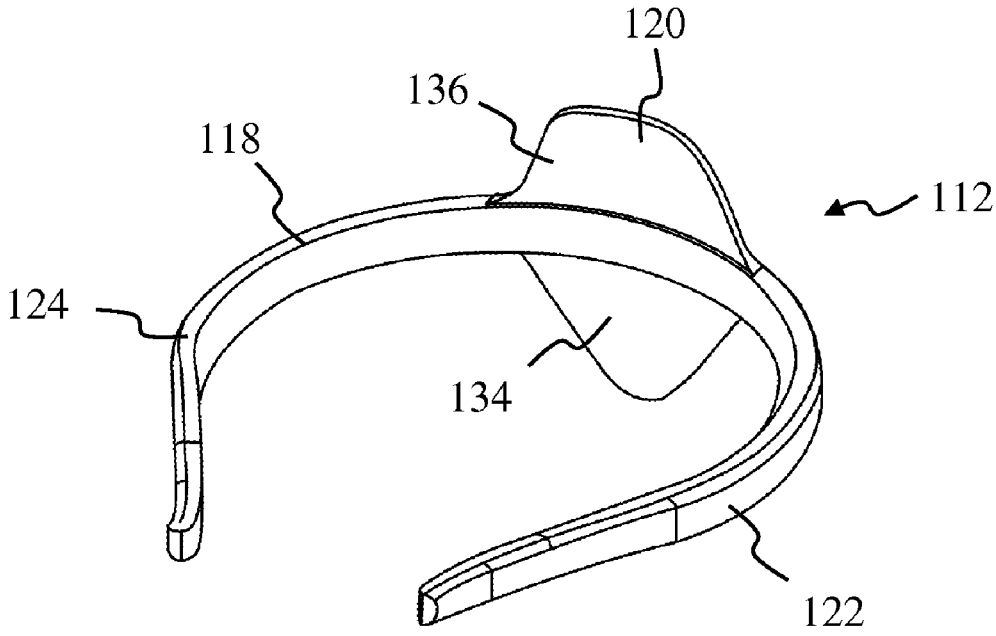
FIG. 6 is a bottom perspective view of headband 112 of device for supplementing human hair 110 of FIG. 3.
Figure 7:
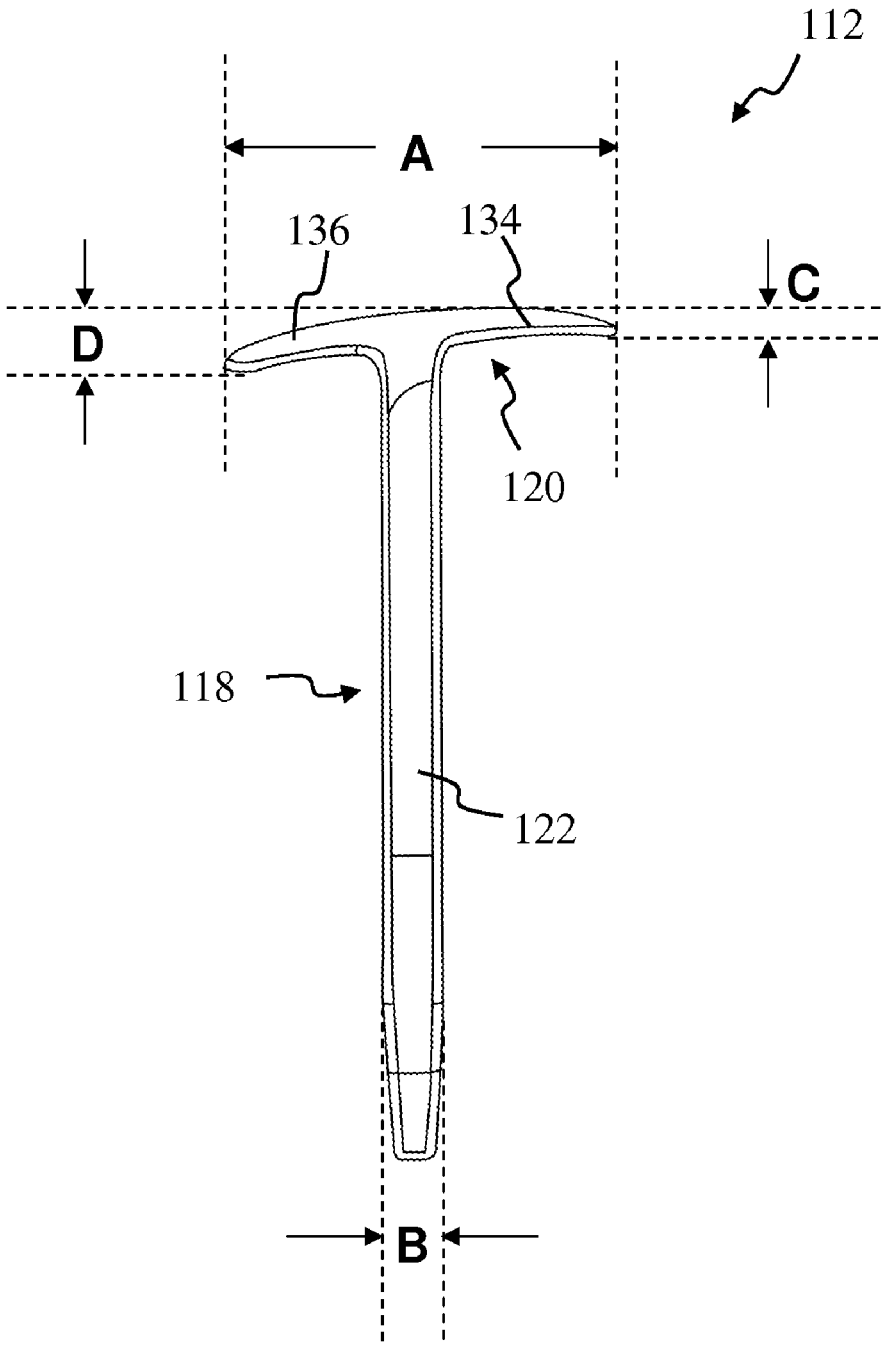
FIG. 7 is a side view of headband 112 of device for supplementing human hair 110 of FIG. 3.
Figure 8:
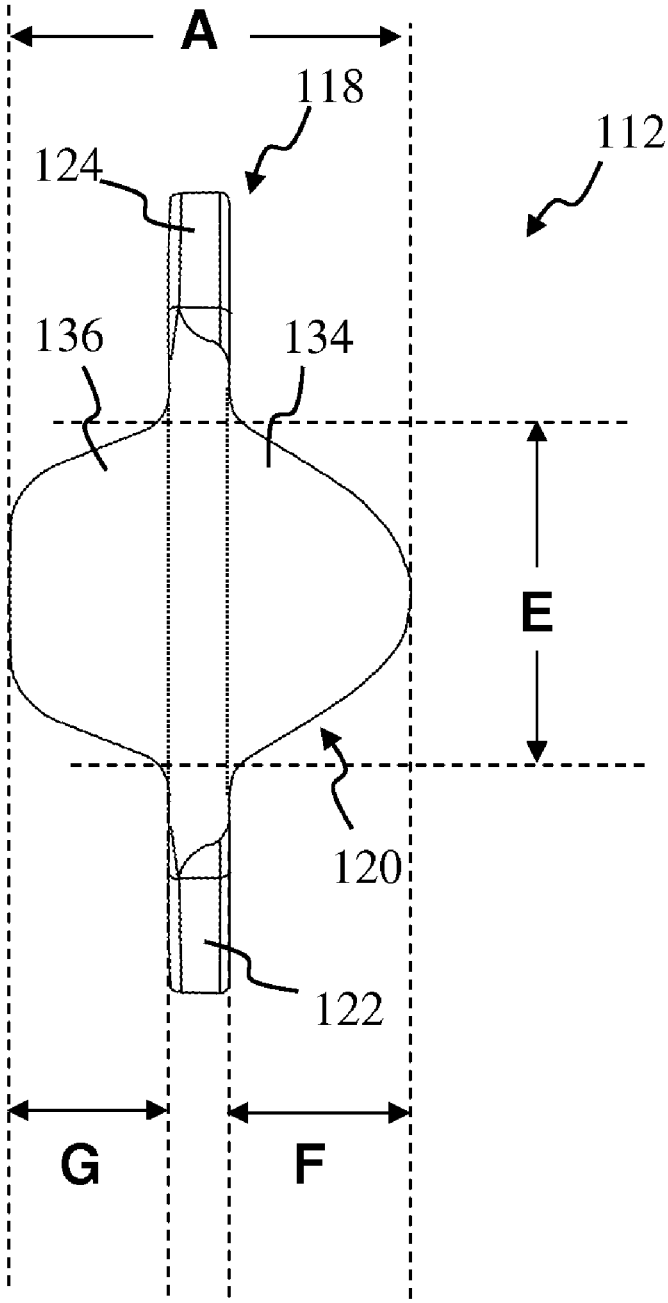
FIG. 8 is a top view of headband 112 of device for supplementing human hair 110 of FIG. 3.

Headband 112 includes headband body portion 118 and crown piece 120, as shown in FIG. 2, FIG. 3, and in FIG. 6 through FIG. 8. FIG. 6 shows a bottom perspective view of headband 112 of device for supplementing human hair 110 according to the invention of FIG. 3. FIG. 7 shows a side view of headband 112 of FIG. 6, and FIG. 8 shows a top view of headband 112 of FIG. 6. Headband body portion 118 is shaped to frictionally engage human scalp 116, as shown in FIG. 4 and FIG. 5. Crown piece 120 is the portion of headband 112 that hairpiece 114 couples to. Headband body portion 118 and crown piece 120 are formed of one integral piece in this embodiment, but hair supplementing device 110 according to the invention is not limited in this aspect.

Crown piece 120 is a platform used to hold hairpiece 114 securely to headband 112. In this embodiment crown piece 120 is a flat disc-shaped element coupled to the top of headband body portion 118. In this embodiment crown piece 120 is formed of material about 1/16 inch thick, but crown piece 120 according to the invention can be other thicknesses. Crown piece 120 is arched to fit the shape of the crown of the head, as shown in FIG. 7. FIG. 8 illustrates that crown piece 120 in this embodiment has a top view shape that is somewhat egg-shaped. Crown piece 120 can be any shape, including round, oval, square, triangular, elliptical, or any other shape which allows hairpiece 114 to be coupled to headband 112. Crown piece 120 can be many different sizes. Crown piece 120 is sized to securely couple hairpiece 114 to headband 112, while also fitting comfortably on the top of a head. In the embodiment shown FIG. 6 through FIG. 8, crown piece 120 has a front to back length A of about 2 and ½ inches. This length provides a size for securely holding hairpiece 114 to headband 112 while not covering too much of scalp 116 or existing hair 140. In some embodiments crown piece length A is between about 2 inches and about 3 inches. In some embodiments crown piece A has a length smaller than 2 inches or larger than 3 inches.

In the embodiment shown crown piece 120 has a width E of about 1 and ⅞ inches. This width provides a secure platform for coupling hairpiece 114 to headband 112, while not restricting the length or flexibility of first arm 122 or second arm 124. In some embodiments crown piece 120 has a width E of between about 1 and ½ inches and about 2 and ¼ inches. In some embodiments crown piece 120 has a width E outside this range.

Crown piece 120 can be coupled to headband body portion 118 in many different ways. In some embodiments, such as the embodiment shown in FIG. 6 through FIG. 8, crown piece 120 is formed as an integral part of headband 112. In this embodiment crown piece 112 is an integral part of headband body portion 118. In some embodiments crown piece 120 is formed as a separate piece from headband body portion 118, with crown piece 120 being coupled to headband body portion 118. In some embodiments crown piece 120 is removably coupled to headband body 118. In some embodiments crown piece 120 and body portion 118 are made to snap together. In some embodiments crown piece 120 is glued to headband body portion 118. In some embodiments crown piece 120 is screwed, clipped, or otherwise coupled to headband body portion 118 using attachment devices. Crown piece 120 and headband body portion 118 according to the invention can be coupled together in any way. In some embodiments crown piece 120 is formed of a single piece. In some embodiments crown piece 120 is formed of multiple parts coupled together to form crown piece 120.

In the embodiment of headband 112 shown in FIG. 6 through FIG. 8, headband 112 includes headband body portion 118, where headband body portion 118 is a U-shaped band which frictionally grabs human scalp 116. In some embodiments headband body portion 118 is a rowlock arch shape. Headband body portion 118 in this embodiment includes first headband arm 122 and second headband arm 124. First headband arm 122 and second headband arm 124 are often flexible so they can be flexed apart from one another to place them over scalp 116. Once in place on a human head, first headband arm 122 and second headband arm 124 frictionally engage scalp 116 so that headband 112 stays in place on scalp 116. First headband arm 122 and second headband arm 124 in this embodiment are flexibly biased towards their resting position so that they frictionally grab scalp 116. In some embodiments headband body portion 118 includes elements which help hold headband body portion 118 to scalp 116. In some embodiments first arm 122 and/or second arm 124 have a length that is adjustable to allow them to fit to different size heads and on different positions on the head.

In the embodiment of headband 112 shown in FIG. 1 and FIG. 2, headband body portion 118 includes teeth 138. In some embodiments headband body portion 118 includes other gripping elements. In some embodiments first headband arm 122 and/or second headband arm 124 are rubber coated on the tips to help hold headband 112 in place on scalp 116.

Headband body portion 118 can be many different sizes and shapes and materials. In this embodiment headband body portion 118 has a width B as shown in FIG. 7. In this embodiment width B is about ⅜ inch wide. In some embodiments width B is between about ¼ inch and about ½ inch. In some embodiments width B is other values. In the embodiment shown in FIG. 6 through FIG. 8, headband body portion 118 has a thickness of about 3/16 inch thick. In some embodiments headband body portion 118 has other thickness values. Headband body portion 118 is formed of flexible plastic in this embodiment. In some embodiments headband body portion 118 is formed of other materials. Headband body portion 118 can be formed of any material which allows headband body portion to comfortably and securely engage the human head.

Crown piece 120 according to the invention can take many different forms. In the embodiments shown, crown piece 120 of headband 112 includes two elements, front portion 134, and rear portion 136, as shown in FIG. 6 through FIG. 8. In some embodiments crown piece 120 is formed of a single element. In some embodiments crown piece 120 is formed of more than two elements. Front portion 134 extends outward from headband body portion 118 in a frontward direction. Rear portion 136 extends outward from headband body portion 118 in a rearward direction. In this embodiment front portion 134 and rear portion 136 of crown piece 120 are formed as an integral part of headband body portion 118. In some embodiments front portion 134 and/or rear portion 136 are formed separately and coupled to headband body portion 118. In some embodiments front portion 134 and/or rear portion 136 of crown piece 120 snap onto headband body portion 118. In some embodiments front portion 134 and/or rear portion 136 of crown piece 120 are glued onto headband body portion 118. In some embodiments front portion 134 and/or rear portion 136 of crown piece 120 are coupled to headband body portion 118 with attachments devices such as screw, bolts, rivets, or other attachment devices.

As mentioned earlier, crown piece 120 is arched to fit the crown of the head, as shown in FIG. 7. In this embodiment, crown piece 120 is about 1/16 inches thick. Crown piece 120 is arched with different arch depths C and D. The arch depths C and D can be chosen to fit different sizes and shapes of heads as desired. In the specific embodiment shown in the figures, front portion 134 has an arch depth C of about 3/16 inch, and rear portion 136 has an arch depth D of about ⅜ inch. In some embodiments the arch depth C is between about ⅛ inch and about 5/16 inch. In some embodiments the arch depth B is between about ¼ inch and about ½ inch. Arch depths C and D can be chosen to be any dimension to fit specific sizes and shapes of heads 142.

Front portion 134 can be made any size and shape that allows coupling of hairpiece base 126 to front portion 134, and fits comfortably on a head. In the embodiment of headband 112 shown in FIG. 6 through FIG. 8, front piece 134 is an approximation of a rounded triangular shape, as shown in FIG. 8. In this embodiment front piece 134 protrudes a width F from headband body portion 118, where width F is a distance of about 1 and ⅛ inch. In some embodiments front piece 134 protrudes a width F from headband body portion 118, where width F is a distance between about 1 inch and about 1 and ¼ inch from headband body portion 118. In some embodiments front piece 134 protrudes a width F from headband body portion 118, where width F is a distance between about ¾ inch and about 1 and ½ inches from headband body portion 118. In some embodiments front piece 134 protrudes a width F from headband body portion 118, where width F is a distance larger or smaller than 1 and ⅛ inches. It is to be understood that front portion 134 can be any size or shape that fulfils its purpose of coupling hairpiece 114 onto headband 112.

Rear portion 136 can be made any size and shape that allows coupling of hairpiece base 126 to rear portion 136, and fits comfortably on a head. In the embodiment of headband 112 shown in FIG. 6 through FIG. 8, rear portion 136 is an approximation of a rounded rectangular shape, as shown in FIG. 8. In this embodiment rear portion 136 protrudes a width G from headband body portion 118, where width G is a distance of about 1 inch. In some embodiments rear portion 136 protrudes a width G from headband body portion 118, where width G is a distance between about ¾ inch and about 1 and ¼ inch from headband body portion 118. In some embodiments rear portion 136 protrudes a width G from headband body portion 118, where width G is a distance between about ½ inch and about 1 and ½ inch from headband body portion 118. In some embodiments rear portion 136 protrudes a width G from headband body portion 118, where width G is a distance larger or smaller than 1 inch. It is to be understood that rear portion 136 can be any size or shape that fulfils its purpose of coupling hairpiece 114 onto headband 112.

As discussed earlier, hairpiece 114 is coupled to headband 112. In particular, hairpiece 114 is coupled to headband 112 because hairpiece base 126 is coupled to crown piece 120. Hairpiece base 126 is coupled to crown piece 120 so that hairpiece 114 is attached to headband 112. Headband 112 is holding onto scalp 116. Hairpiece 114 is attached to headband 112 so that hairpiece 114 stays in place on scalp 116, allowing set of hair 128 to supplement hair 140 of the person wearing device for supplementing human hair 110.

Hairpiece base 126 can be coupled to crown piece 120 in many different ways. In the embodiments shown in FIG. 1 through FIG. 5, hairpiece base 126 is glued to crown piece 120. In device for supplementing human hair 110 according to the invention, hairpiece base 126 can be adhesively coupled to crown piece 120 with any suitable glue, adhesive, epoxy, or other bonding material.

In some embodiments hairpiece base 126 is coupled to crown piece 120 with pairs of coupling elements. For example, in one embodiment of device for supplementing human hair 110 according to the invention, hook and loop attachments are used to couple hairpiece base 126 to crown piece 120. The hook portion or the loop portion can be coupled to hairpiece base 126, and the other mating portion coupled to crown piece 120. In another example, snaps are used to couple hairpiece base 126 to crown 120, with half of the snap connectors mounted to hairpiece base 126 and the other snap mating halves coupled to crown piece 120.

Figure 9:
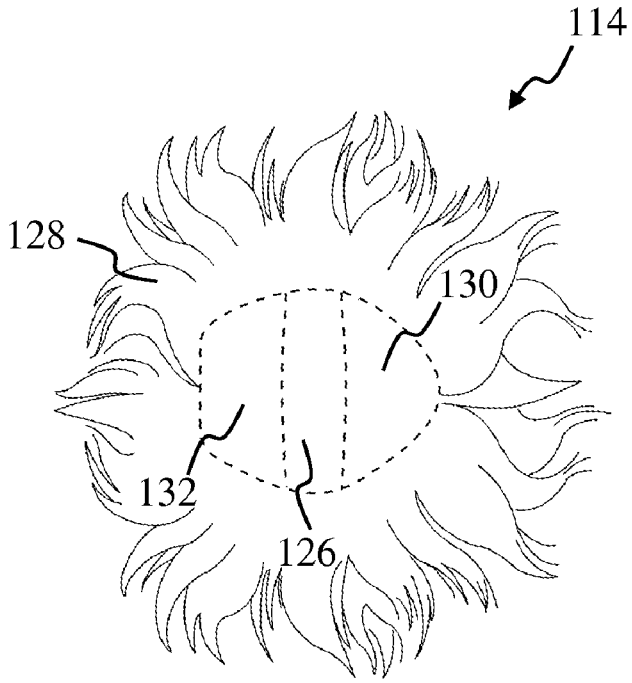
FIG. 9 is a top view of an embodiment of hairpiece 114 according to the invention.
Figure 10:
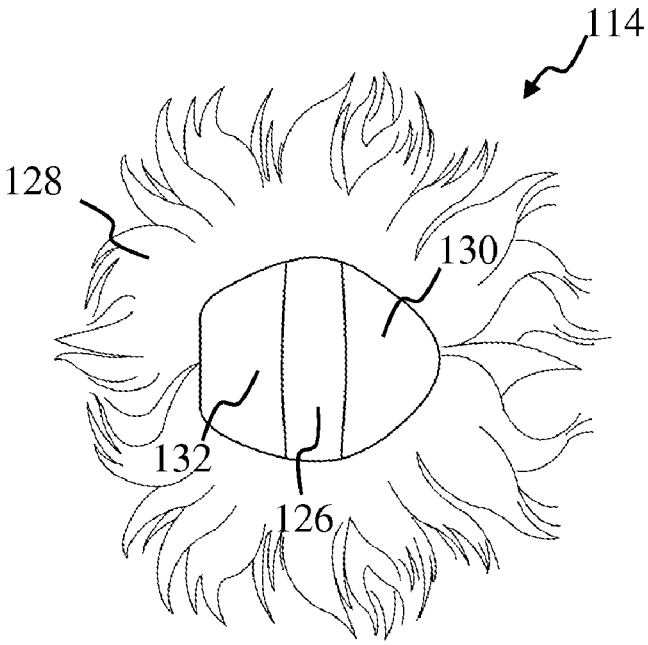
FIG. 10 is a bottom view of hairpiece 114 of FIG. 9.
Figure 11:
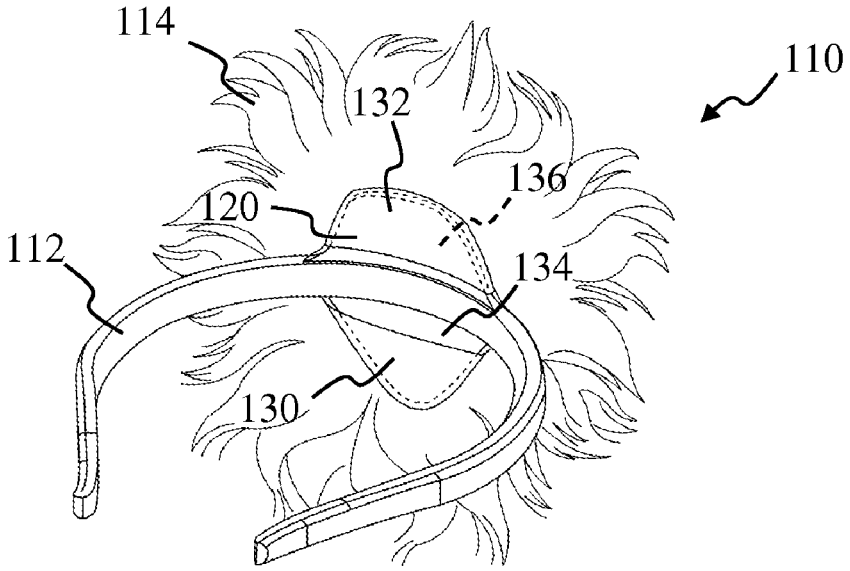
FIG. 11 is a bottom perspective view of another embodiment of device for supplementing human hair 110 according to the invention, using hairpiece 114 of FIG. 9 and FIG. 10, where hairpiece 114 couples to crown piece 120 using pockets 130 and 132.

In another particular embodiment, hairpiece base 126 includes one or more than one pocket which receives crown piece 120. In some embodiments hairpiece base 126 include one pocket which receives crown piece 120. In some embodiments hairpiece base 126 includes two pockets which receive crown piece 120. Using pockets to attach hairpiece base 126 to crown piece 120 is shown in FIG. 9 through FIG. 11. FIG. 9 and FIG. 10 show top and bottom views, respectively, of one embodiment of hairpiece 114 according to the invention, including hairpiece base 126 and set of hair 128. FIG. 11 shows a bottom perspective view of an embodiment of device for supplementing human hair 110 according to the invention where device for supplementing human hair 110 includes hairpiece 114 as shown in FIG. 9 and FIG. 10. In this embodiment hairpiece base 126 includes front pocket 130 and rear pocket 132, as shown in FIG. 9 and FIG. 10. Front pocket 130 receives front portion 134 of crown piece 120, as shown in FIG. 11. Rear pocket 132 receives rear portion 136 of crown piece 120, as shown in FIG. 11. With crown piece 120 enclosed by pockets 130 and 132, hairpiece 114 is held securely to crown piece 120, which holds hairpiece 114 to headband 112. In this way device for supplementing human hair 110 includes hairpiece base 126 which includes one or more than one pocket 130 and 132, where the one or more than one pocket 130 and 132 receives crown piece 120.

Figure 12:
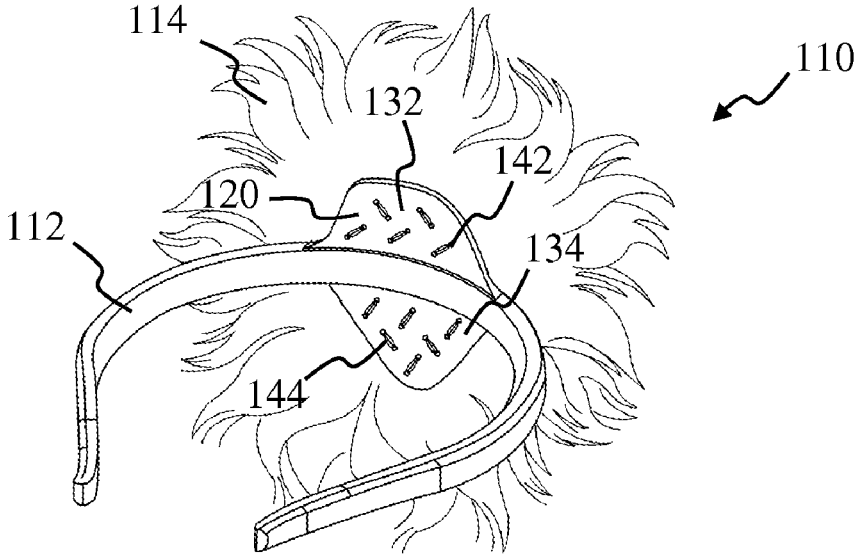
FIG. 12 is a bottom perspective view of a further embodiment of device for supplementing human hair 110 according to the invention, where hairpiece 114 is sewn to crown piece 120 using holes 142 and thread 144.

In another embodiment hairpiece base 126 is coupled to crown piece 120 by using stitches to sew hairpiece base 126 to crown piece 120. This embodiment is shown in FIG. 12. FIG. 12 is a bottom perspective view of an embodiment of device for supplementing human hair 110 according to the invention where hairpiece base 126 is sewn to crown piece 120. In this embodiment crown piece 120 include holes 142 (one of several numbered). Holes 142 can be used to pass thread 144 (one of several numbered) or other filament through to sew hairpiece base 126 onto crown piece 120. In some embodiments holes 142 are used to tie hairpiece base 126 to crown piece 120. These are only a few examples of how hairpiece 114 can be coupled to crown piece 120. It is to be understood that hairpiece 114 can be coupled to headband 112 in any way which holds hairpiece 114 to headband 112. It is to be understood that hairpiece base 126 can be coupled to crown piece 120 in any way which holds hairpiece base 126 to crown piece 120.

Figure 13:
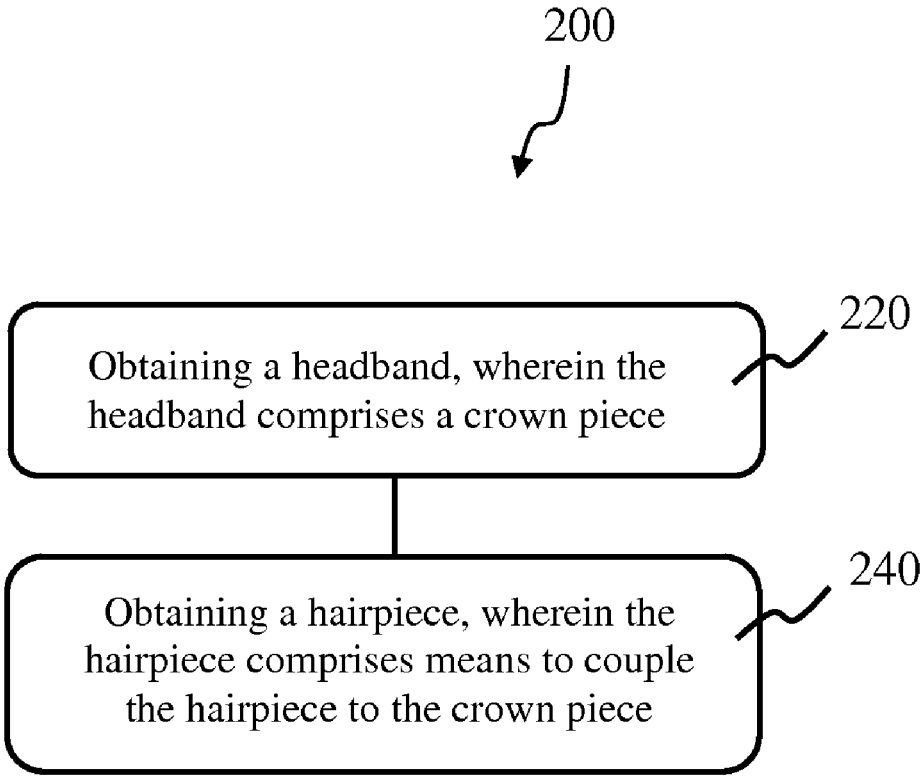
FIG. 13 shows method 200 of forming a hair supplementing device according to the invention.

FIG. 13 shows method 200 of forming a hair supplementing device according to the invention. Method 200 includes step 220 obtaining a headband, where the headband comprises a crown piece, and step 240 obtaining a hairpiece, where the hairpiece comprises means to couple the hairpiece to the crown piece. Method 200 can include many other steps. In some embodiment method 200 includes the step of coupling the hairpiece to the crown piece. In some embodiments method 200 includes the step of placing the hair supplementing device on the head of a user to cut the set of hair of the hairpiece such that it is integrated into the hairstyle of the user's existing hair. In some embodiments method 200 includes the step of placing the hair supplementing device on the head of a user to color or otherwise style the set of hair of the hairpiece such that it integrates into the hairstyle of the user's existing hair.

Step 220 obtaining a headband, wherein the headband comprises a crownpiece, can include any steps involved in forming, creating, or procuring a headband that includes a crown piece. In some embodiments the step of obtaining a headband according to the invention includes the steps of forming a crown piece, coupling a first headband arm to the crown piece, and coupling a second headband arm to the crown piece. In some embodiments the step of obtaining a headband according to the invention includes the steps of forming a headband body portion, forming a crown piece, and coupling the crown piece to the headband body portion. In some embodiments the step of obtaining a headband according to the invention includes the steps of forming a headband body portion, coupling a crown piece front portion to the headband body portion, and coupling a crown piece rear portion to the headband body portion. In some embodiments this step includes forming a crown piece front portion. In some embodiments this step includes forming a crown piece rear portion. In some embodiments the step of obtaining a headband according to the invention includes the step of forming a headband with an integral crown piece. Step 220 obtaining a headband, wherein the headband comprises a crownpiece, can include many other steps. In some embodiments the step of obtaining a headband according to the invention includes the steps of obtaining a headband body portion, and forming a crown piece with holes, wherein the holes can be used to sew the hairpiece to the crown piece.

Step 240 obtaining a hairpiece, where the hairpiece comprises means to couple the hairpiece to the crown piece, can include any steps involved in forming, creating, or procuring a hairpiece that has means to couple the hairpiece to the crown piece. In some embodiments of method 200 according to the invention, step 240 includes forming a hairpiece with a hairpiece base, where the hairpiece base comprises one or more than one pocket for receiving the crown piece. In some embodiments obtaining a hairpiece includes the step of attaching a set of hair to a hairpiece base. In some embodiments obtaining a hairpiece includes the step of obtaining a hairpiece with a hairpiece base, where the hairpiece base includes snaps for coupling the hairpiece base to the crown piece.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A device for supplementing human hair comprising:

a headband shaped to frictionally engage a human scalp comprising a headband body portion, wherein the headband body portion frictionally engages the human scalp, and a crown piece coupled to the headband body portion; and a hairpiece coupled to the headband, wherein the hairpiece comprises a hairpiece base and a set of hair coupled to the hairpiece base, wherein the hairpiece base couples to the crown piece and comprises one or more than one pocket which receives the crown piece.

2. The device of claim 1, wherein the hairpiece base is glued to the crown piece.

3. The device of claim 1 , wherein the hairpiece base is sewn to the crown piece.

4. A hair supplementing device comprising:

a headband shaped to frictionally engage the human scalp, the headband comprising:

a headband body portion, wherein the headband body portion frictionally engages the human scalp;

a crown piece coupled to the headband body portion; and a hairpiece coupled to the crown piece, the hairpiece comprising:

a hairpiece base, wherein the hairpiece base couples to the crown piece, and wherein the hairpiece base comprises one or more than one pocket which receives the crown piece.

5. The device of claim 4, wherein the crown piece is removably coupled to the headband.

6. The device of claim 4, wherein the crown piece is an integral part of the headband.

7. The device of claim 4, wherein the hairpiece is removably coupled to the crown piece.

8. The device of claim 4, wherein the crown piece further comprises:

a front portion, wherein the front portion extends out from a headband body portion in a frontward direction; and a rear portion, wherein the rear portion extends out from the headband body portion in a rearward direction.

9. The device of claim 4, wherein the crown piece has a length of about 2 and ½ inches.

10. The device of claim 4, wherein the crown piece has a width of about 1 and ⅞ inches.

* * * * *